US007683246B2

(12) United States Patent
Hashimoto

(10) Patent No.: US 7,683,246 B2
(45) Date of Patent: Mar. 23, 2010

(54) MUSICAL INSTRUMENT PLAYING ACTUATOR, PLAY ASSISTING MOUTHPIECE, BRASS INSTRUMENT, AUTOMATIC PLAYING APPARATUS, AND PLAY ASSISTING APPARATUS

(75) Inventor: Ryuji Hashimoto, Hamamatsu (JP)

(73) Assignee: Yamaha Corporation (JP)

( * ) Notice: Subject to any disclaimer, the term of this patent is extended or adjusted under 35 U.S.C. 154(b) by 4 days.

(21) Appl. No.: 12/127,935

(22) Filed: May 28, 2008

(65) Prior Publication Data

US 2008/0295669 A1 Dec. 4, 2008

(30) Foreign Application Priority Data

May 28, 2007 (JP) ..... 2007-140602

(51) Int. Cl.
*G10D 7/10* (2006.01)

(52) U.S. Cl. ..... 84/387 R

(58) Field of Classification Search ..... 84/387 R, 84/387 A

See application file for complete search history.

(56) References Cited

U.S. PATENT DOCUMENTS

| | | | | |
|---|---|---|---|---|
| 8,449 A | | 10/1851 | Meech | |
| 147,759 A | | 2/1874 | Fowler | |
| 3,339,444 A | | 9/1967 | Brooks | |
| 6,083,075 A | * | 7/2000 | Meeks | 446/207 |

FOREIGN PATENT DOCUMENTS

| | | | |
|---|---|---|---|
| JP | 2004-177828 A | | 6/2004 |
| JP | 2004-258443 A | | 9/2004 |
| JP | 2006-3581 A | | 1/2006 |
| JP | 2006-3582 A | | 1/2006 |
| JP | 2007065196 A | * | 3/2007 |

OTHER PUBLICATIONS

Notification of Reason for Refusal issued in corresponding Japanese patent application No. 2007-140602, dated Jan. 6, 2009.
Extended search report, dated Sep. 29, 2008, issued in corresponding EP application No. 08157075.6-1240.

* cited by examiner

*Primary Examiner*—Kimberly R Lockett
(74) *Attorney, Agent, or Firm*—Rossi, Kimms & McDowell LLP

(57) ABSTRACT

A musical instrument playing actuator, includes an elastic diaphragm which has a through hole, wherein an annular projection portion is provided on the elastic diaphragm so as to project toward the diaphragm member, a diaphragm member which is arranged to oppose to the elastic diaphragm and is formed movably toward the elastic diaphragm, a wall structure body which forms an enclosed space together with the elastic diaphragm, the diaphragm member, and the projection portion when the diaphragm member is moved toward the elastic diaphragm to contact the projection portion, and an air inlet which communicates the enclosed space with an outside.

11 Claims, 7 Drawing Sheets

MUSICAL INSTRUMENT PLAYING ACTUATOR, PLAY ASSISTING MOUTHPIECE, BRASS INSTRUMENT, AUTOMATIC PLAYING APPARATUS, AND PLAY ASSISTING APPARATUS

This application is based on, and claims priority to, Japanese Patent Application No: 2007-140602, filed on May 28, 2007. The disclosure of the priority application, in its entirety, including the drawings, claims, and the specification thereof, is incorporated herein by reference.

BACKGROUND

The present invention relates to the technology to assist a play of a wind instrument.

Unlike the single-reed or double-reed instrument of the woodwind instrument that produces a sound by breathing into the instrument to vibrate the reed, the lip-reed type instrument such as the brass instrument produces a sound by vibrating the player's lip. For this reason, training of an extremely high order is required of the player, and also a burden on the player is physically heavy. Therefore, in order to make it possible for the brass instrument to produce a sound by blowing an air into it as in the woodwind instrument, such a technology is disclosed that an artificial lip is formed by using a flexible member and then a sound is produced by blowing an air into the artificial lip to vibrate it (see Patent Literature 1, for example).

[Patent Literature 1] JP-A-2004-177828

However, in the technology set forth in Patent Literature 1, the amplitude is small because of structural restriction of an artificial lip, and therefore it is difficult to produce a sound at a high volume. Also, when the technology tries to produce a low-pitched sound, merely an air passes through the artificial lip and it becomes hard to generate the vibration, and as a result a playable range is narrowed.

SUMMARY

The present invention has been made in view of the above circumstances, and it is an object of the present invention to provide a musical instrument playing actuator, a play assisting mouthpiece, a brass instrument, an automatic playing apparatus, and a play assisting apparatus, capable of producing a sound by simply blowing an air into it and also producing the sound at a high volume and over a wide range.

In order to solve the above problem, the present invention provides a musical instrument playing actuator, comprising:

an elastic diaphragm which has a through hole, wherein an annular projection portion is provided on the elastic diaphragm so as to project toward the diaphragm member;

a diaphragm member which is arranged to oppose to the elastic diaphragm and is formed movably toward the elastic diaphragm;

a wall structure body which forms an enclosed space together with the elastic diaphragm, the diaphragm member, and the projection portion when the diaphragm member is moved toward the elastic diaphragm to contact the projection portion; and an air inlet which communicates the enclosed space with an outside.

Preferably, the projection portion is provided on the elastic diaphragm so as to surround a periphery of the through hole.

Preferably, the air inlet is provided to the wall structure body.

Preferably, the musical instrument playing actuator further includes a pressing member which moves the diaphragm member toward the elastic diaphragm.

Here, it is preferable that, the pressing member includes a blowing port for blowing an air into an internal space of the pressing member, and an air introducing path for connecting the internal space and the air inlet.

Preferably, at least a portion, which contacts the diaphragm member, of the projection portion is formed of an elastic material.

Preferably, at least a portion, which contacts the projection portion, of the diaphragm member is formed of an elastic material.

Also, the present invention provides a play assisting mouthpiece, comprising:

the musical instrument playing actuator; and a mouthpiece for a brass instrument which includes a rim having an inner diameter, wherein a diameter of the through hole in the elastic diaphragm is smaller than the inner diameter of the rim; and wherein the musical instrument playing actuator is provided so that the rim comes into contact with the elastic diaphragm so as to surround the through hole in the elastic diaphragm.

Also, the present invention provides a brass instrument to which the play assisting mouthpiece is fitted.

Also, the present invention provides an automatic playing apparatus, comprising:

the brass instrument;

a controlling section which acquires musical sound data having information to specify a pitch and a sound volume, decides a pressure based on the pitch of the musical sound data, outputs a pressure control signal indicating the pressure, decides a flow rate based on the sound volume of the musical sound data, and outputs a flow rate control signal indicating the flow rate;

a moving section which moves the diaphragm member toward the elastic diaphragm at the pressure indicated by the pressure control signal; and an air sending section which sends an air into the enclosed space at the flow rate indicated by the flow rate control signal via the air inlet.

Also, the present invention provides a play assisting apparatus, comprising:

the automatic playing apparatus;

a sound sensing section which is provided to a player mouthpiece, for sensing the sound that is produced when a player's breath is blown into the blowing port of the player mouthpiece; and a musical sound data generating section which generates musical sound data based on the sound sensed by the sound sensing section, wherein the controlling section of the automatic playing apparatus acquires the musical sound data generated by the musical sound data generating section.

According to the present invention, the musical instrument playing actuator, the play assisting mouthpiece, the brass instrument, the automatic playing apparatus, and the play assisting apparatus, which are capable of producing a sound by simply blowing an air into them and also producing the sound at a high volume and over a wide range, can be provided.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

An embodiment of the present invention will be explained hereinafter.

Embodiment

Figure 1:
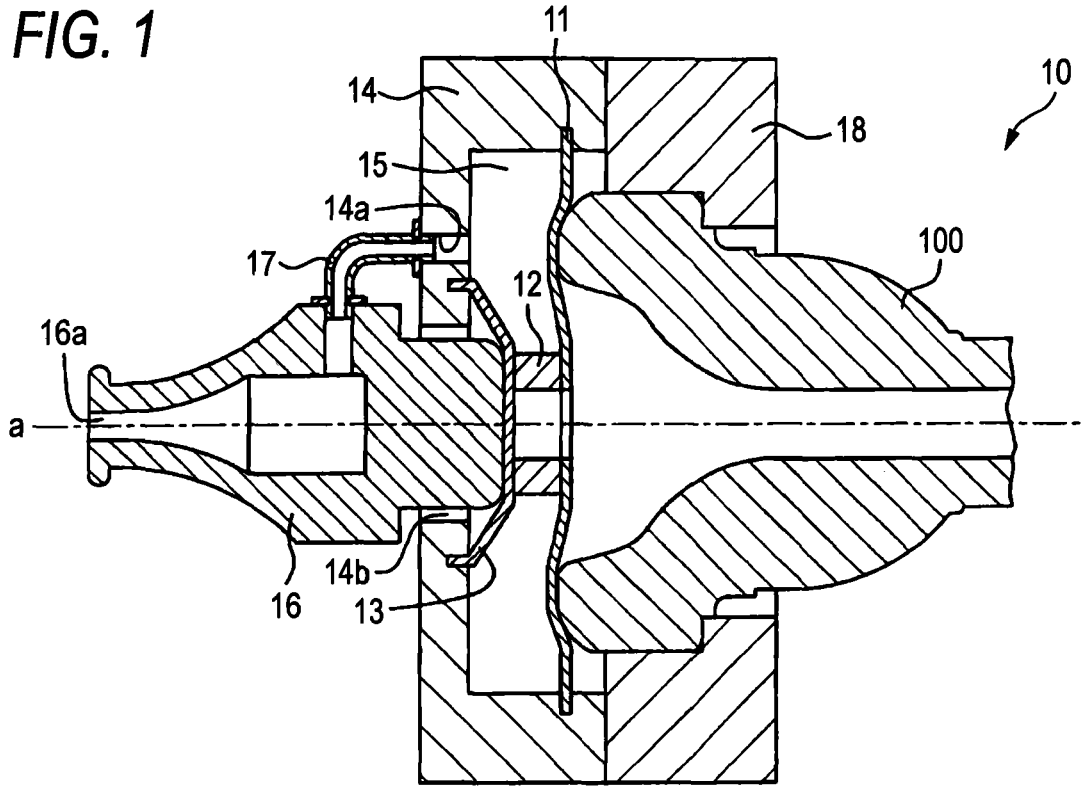
FIG. 1 is sectional view showing a structure of a musical instrument playing actuator according to an embodiment.
Figure 2:
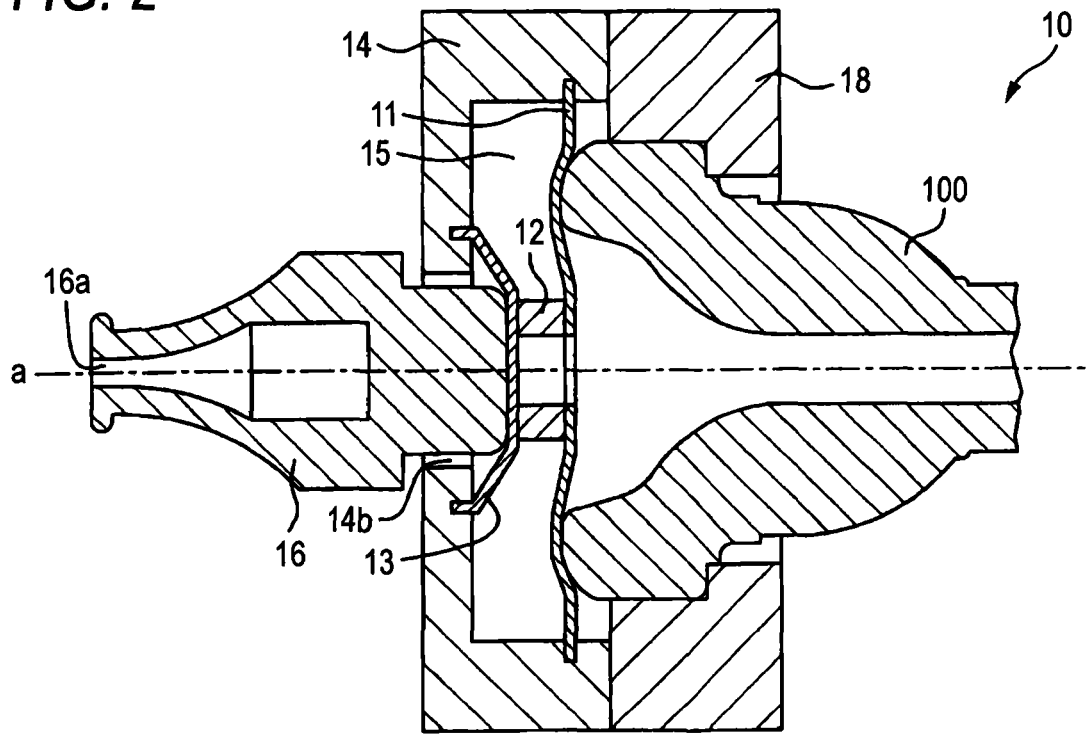
FIG. 2 is a sectional view showing the structure of the musical instrument playing actuator according to the embodiment.

A musical instrument playing actuator 10 according to the present embodiment is an actuator that can be fitted to a mouthpiece 100. The musical instrument playing actuator 10 connected to the mouthpiece 100 has a structure whose sectional structure is shown in FIG. 1 and FIG. 2. FIG. 1 is a view showing a sectional structure of the musical instrument playing actuator 10 when cut by a plane containing an air inlet 14*a* described later. FIG. 2 is a view showing the sectional structure of the same when cut by a plane perpendicular to the plane containing the air inlet 14*a*. A cubic structure of the musical instrument playing actuator 10 is given roughly as a body of rotation obtained when the sectional structure shown in FIG. 2 is rotated on an axis a, and a part of the section gives the structure shown in FIG. 1. Then, the structure of the musical instrument playing actuator 10 will be explained with reference to FIG. 1 hereunder.

An elastic diaphragm 11 is a circular diaphragm formed of the elastic material (in the present embodiment, a polyester film of a thickness of 0.1 mm), and a circular through hole is provided in the center portion of the elastic diaphragm 11. A periphery of the elastic diaphragm 11 is supported with a wall structure body 14. Also, a diameter of the through hole is set smaller than an inner diameter of a rim of the mouthpiece 100.

A projection member 12 is an annular member that is formed of the elastic material (in the present embodiment, a nitrile rubber having a Shore A hardness of 50). The projection member 12 is provided to surround a periphery of the through hole in the elastic diaphragm 11 and protrude to a diaphragm member 13 side described later. Here, the elastic diaphragm 11 and the projection member 12 come into contact mutually not to flow an air through therebetween. For example, these members are fixed by the adhesive, or the like.

The diaphragm member 13 is a circular diaphragm that is formed of the elastic material (in the present embodiment, a polyester film of a thickness of 0.1 mm), and is arranged to oppose to the elastic diaphragm 11. Then, a periphery of the diaphragm member 13 is supported with the wall structure body 14, and the diaphragm member 13 closes an opening portion 14*b* described later.

The wall structure body 14 is a hollow cylindrical structure body. A bottom surface (a surface on the right side in FIGS. 1 and 2) of the wall structure body 14 on a fitting member 18 side described later is fully opened, and the fitting member 18 can be connected to this bottom surface. Also, another bottom surface (a surface on the left side in FIGS. 1 and 2) of the wall structure body 14 has an opening portion at two locations. One opening out of two locations is the opening portion 14*b* provided in the center portion of this bottom surface. A part of a pressing member 16 described later can be inserted into the opening portion 14*b*. Accordingly, the pressing member 16 can move the diaphragm member 13 toward the elastic diaphragm 11 side. The other opening is the air inlet 14*a* that communicates an enclosed space 15, which is formed by the elastic diaphragm 11, the projection member 12, the diaphragm member 13, and the wall structure body 14, with the outside of the wall structure body 14 and flows an air into the enclosed space 15 from the outside of the wall structure body 14 in a situation that, as shown in FIG. 1, the diaphragm member 13 is moved by the pressing member 16 toward the elastic diaphragm 11 side and comes into contact with the projection member 12. In the present embodiment, the wall structure body 14 is formed of the aluminum material. But any material such as plastic, other metal, etc. may be employed if such material can ensure enough strength and does not transmit an air.

The pressing member 16 is inserted into the opening portion 14*b*, as described above, and can move the diaphragm member 13 toward the elastic diaphragm 11 side. Also, the pressing member 16 has a space in the inside and has an opening portion at two locations such that space is communicated with the outside through the opening portion at two locations. One opening portion out of two locations is a blowing port 16*a* into an inside of which the player blows an air. Also, the other opening portion and the air inlet 14*a* provided in the wall structure body 14 are connected via a communication tube 17. The communication tube 17 is formed of a flexible member whose shape can be changed following upon the movement of the pressing member 16. As a result, an air that is blown into from the blowing port 16*a* flows into the enclosed space 15 from the air inlet 14*a* via the communication tube 17.

The fitting member 18 is a member that is used to fit the musical instrument playing actuator 10 to the mouthpiece 100 of the brass instrument. The fitting member 18 is a hollow cylindrical structure body. A bottom surface located on the wall structure body 14 side (a surface on the left side in FIGS. 1 and 2) and another bottom surface located on the brass instrument side (a surface on the right side in FIGS. 1 and 2) are opened. A diameter of the opening of the bottom surface on the brass instrument side is smaller than a diameter of the opening of the bottom surface on the wall structure body 14 side, and also is smaller than an outer diameter of the rim of the mouthpiece 100. Also, as shown in FIGS. 1 and 2, the mouthpiece 100 is fitted to the fitting member 18, and the mouthpiece 100 can be fitted to the musical instrument playing actuator 10 by connecting the fitting member 18 and the wall structure body 14. Also, in the present embodiment, the rim of the mouthpiece 100 come into contact with the elastic diaphragm 11 to surround the through hole in the elastic diaphragm 11.

Figure 3:
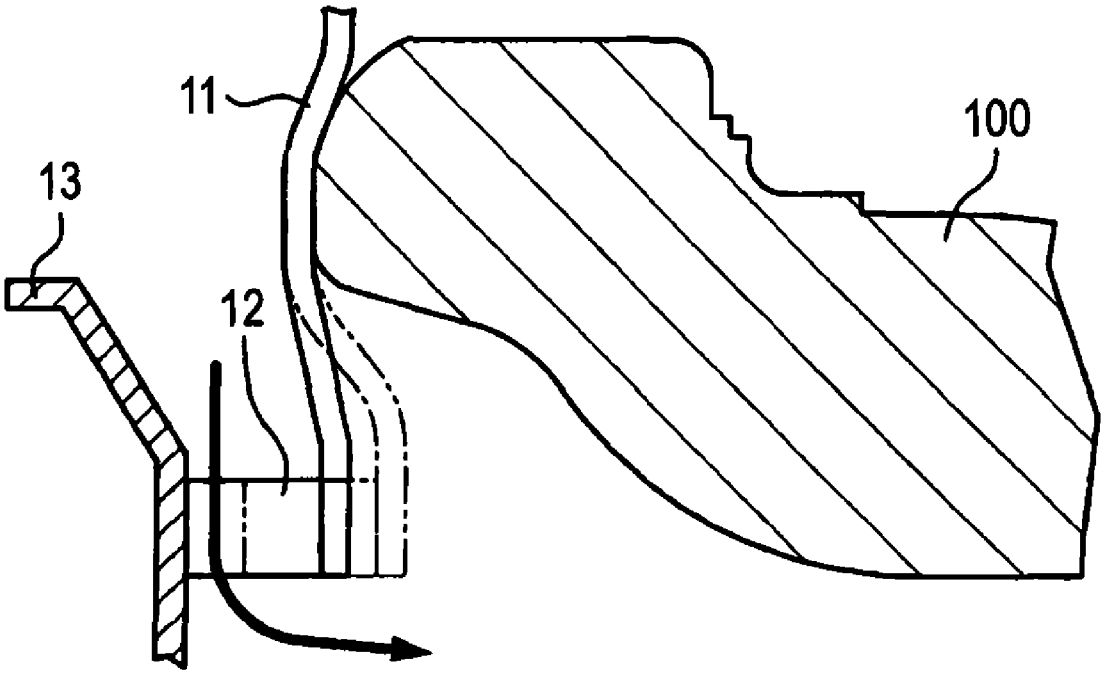
FIG. 3 is an explanatory view showing a behavior of a vibration of an elastic diaphragm of the musical instrument playing actuator according to the embodiment.

Next, an operation of the musical instrument playing actuator 10 to which the mouthpiece 100 is fitted will be explained with reference to FIG. 3 hereunder. FIG. 3 is an explanatory view showing respective operations of a contact portion between the elastic diaphragm 11 and the mouthpiece 100 and a contact portion between the projection member 12 and the diaphragm member 13 in FIG. 1 and FIG. 2 in an enlarged manner when an air is blown from the blowing port 16*a*.

When the player blows an air from the blowing port 16*a*, this air flows into the enclosed space 15 from the air inlet 14*a* via the communication tube 17. When a pressure of the air in the enclosed space 15 is increased, the elastic diaphragm 11 and the projection member 12 move as shown by a chain double-dashed line in FIG. 3 such that the projection member 12 is separated from the diaphragm member 13, and then the air flows out to the mouthpiece 100 side, as indicated with an arrow in FIG. 3. When a pressure of the air in the enclosed space 15 is decreased after the air flown out, the projection member 12 comes again into contact with the diaphragm member 13 by a tension of the elastic diaphragm 11.

While the player blows an air from the blowing port 16*a*, the projection member 12 touches and comes off the diaphragm member 13 as described above, and thus the elastic diaphragm 11 vibrates and produces a sound. At this time, when the player increases a volume of inflow of air (referred to as a "volume of inflow" hereinafter), a flow rate of the air that passes through a clearance between the projection member 12 and the diaphragm member 13 is increased. Thus, the projection member 12 is pushed up largely toward the mouthpiece 100 side, and an amplitude of a vibration of the elastic diaphragm 11 is increased to produce the sound at a high volume. Conversely, when the player decreases a volume of inflow, an amplitude of a vibration of the elastic diaphragm 11 is decreased to produce the sound at a low volume. In this manner, the player can change a sound volume by changing the volume of inflow.

Also, when the player pushes in the pressing member 16 toward the mouthpiece 100 side, the diaphragm member 13 and the projection member 12 are pushed in toward the mouthpiece 100 side. Thus, the elastic diaphragm 11 is expanded and pushed into the inside of the cup of the mouthpiece 100, and a tension of the elastic diaphragm 11 is increased. As a result, a natural oscillation frequency of the elastic diaphragm 11 and the projection member 12 being vibrated becomes high, and the produced sound becomes a high-pitched sound. In contrast, when the player pulls back the pressing member 16 in the reverse direction to the above direction (in the opposite direction to the mouthpiece 100 side), a tension of the elastic diaphragm 11 is decreased. As a result, a natural oscillation frequency of the elastic diaphragm 11 and the projection member 12 becomes low, and the produced sound becomes a low-pitched sound. In this manner, the player can change a pitch by changing a pushing stroke of the pressing member 16. In this case, in pushing in the pressing member 16, the player also pushes in the elastic diaphragm 11, the projection member 12, and the diaphragm member 13. Therefore, the player must push in the pressing member 16 against the reactive force from these members. As a result, a pushing stroke of the pressing member 16 can be controlled based on the pressure.

As described above, the player can produce the sound simply by blowing an air into the musical instrument playing actuator 10, and also can control the pitch and the sound volume by adjusting the pushing stroke of the pressing member 16 and the volume of inflow of an air. Therefore, when the player only controls the pushing stroke of the pressing member 16 while blowing an air into the musical instrument playing actuator 10 to which the mouthpiece 100 used in the lip-reed type instrument such as the brass instrument, or the like is fitted, such player can play the musical instrument to which the mouthpiece 100 is fitted by the same sound as that being produced by the human lips.

With the above, the embodiment of the present invention is explained. However, the present invention can be carried out in various modes hereunder.

<Variation 1>

Figure 4B:
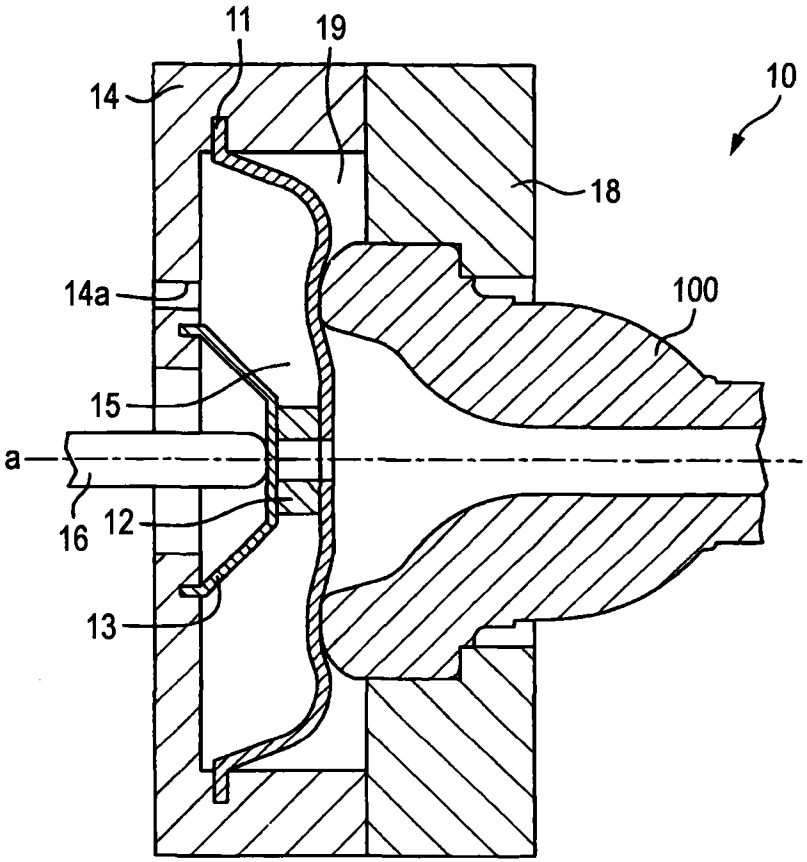
FIG. 4 is a sectional view showing a structure of a musical instrument playing actuator according to a variation 1.
Figure 4A:
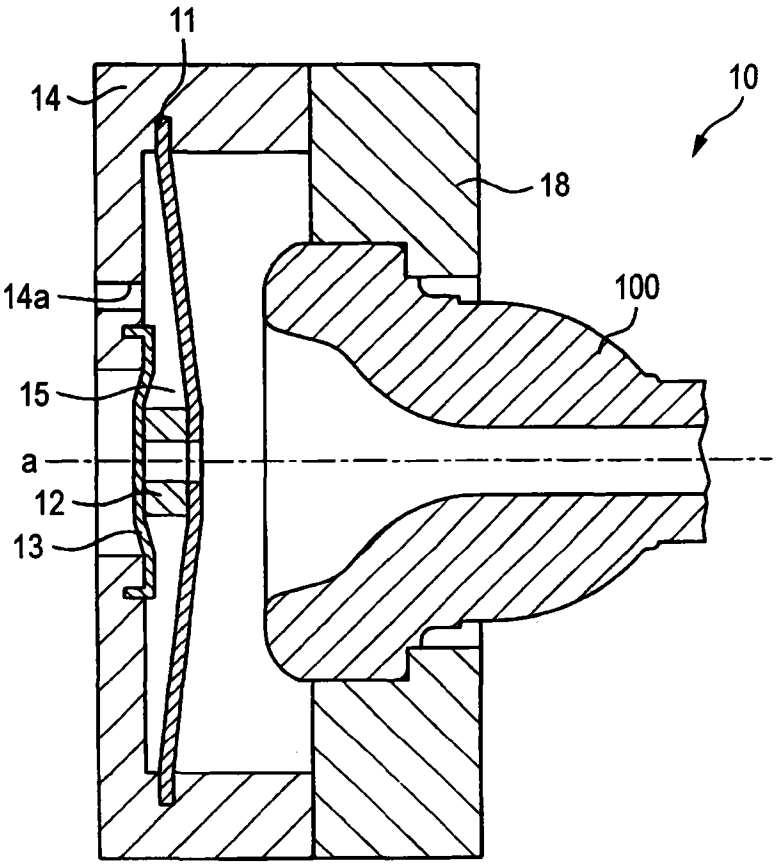

In the embodiment, in a situation that the musical instrument playing actuator 10 is fitted to the mouthpiece 100, the elastic diaphragm 11 comes in touch with the rim of the mouthpiece 100 unless the pressing member 16 pushes in the diaphragm member 13. However, the elastic diaphragm 11 may not come in touch with the rim of the mouthpiece 100 in a state that the diaphragm member 13 is not pushed in by the pressing member 16. In this case, as shown in FIG. 4A, a position where the elastic diaphragm 11 is supported by the wall structure body 14 may be put closer to the diaphragm member 13 side. Also, when the musical instrument playing actuator 10 is caused to produce the sound, the player may blow an air into the enclosed space 15 while pushing in the pressing member 16 such that the elastic diaphragm 11 comes in touch with the rim of the mouthpiece 100, as shown in FIG. 4B. In other words, any arrangement may be employed if the elastic diaphragm 11 can come in touch with the rim of the mouthpiece 100 by pushing in the pressing member 16.

By the above configuration, a tension of the elastic diaphragm 11 can be increased and thus the musical instrument playing actuator 10 suitable for the sound in a high-pitched sound range can be provided. Also, an auxiliary space 19 constructed by the elastic diaphragm 11, the wall structure body 14, the fitting member 18, and the mouthpiece 100 can be set largely. Therefore, the elastic diaphragm 11 is moved to expand toward the auxiliary space 19 side when an air is flown into the enclosed space 15, so that the enclosed space 15 can be set largely. When doing this, an air in the enclosed space 15 can be sent out to the mouthpiece 100 side by a tension of the portion of the elastic diaphragm 11 constituting the auxiliary space 19. Hence, even when a flow rate of an air is in an unstable state, stability of the sound volume can be improved. Here, the pressing member 16 in FIG. 4B is different in shape from the pressing member 16 explained in the above embodiment. In this case, any structure may be employed if the pressing member 16 can push in the diaphragm member 13 such that the diaphragm member 13 comes in touch with the projection member 12. For example, the pressing member 16 may not have the space in the inside. In this case, the blowing port 16*a* is separately provided from the pressing member 16.

<Variation 2>

In the embodiment, the projection member 12 is formed of the elastic material. But the projection member 12 is not always formed of the elastic material. For example, when a hard substance such as a metal, or the like is employed, the sound of the sound quality different from that in the embodiment can be produced. Also, the overall projection member 12 may not be the same substance. For example, only the portion contacting the diaphragm member 13 may be the elastic material, and remaining portions may be formed of a metal. In other words, the material of the portion of the projection member 12 contacting the diaphragm member 13 may be decided to meet a desired sound quality, and the material of the portion of the projection member 12 contacting the elastic diaphragm 11 may be decided based on the compatibility in adhesion between them. Also, a natural oscillation frequency of the elastic diaphragm 11 and the projection member 12 may be controlled by changing the material (e.g., changing into the material having a different specific gravity). Also, the projection member 12 may be integrally formed on the elastic diaphragm 11, for example, the projection member 12 is formed as a projection portion which is a part of the elastic diaphragm 11.

Figure 5:
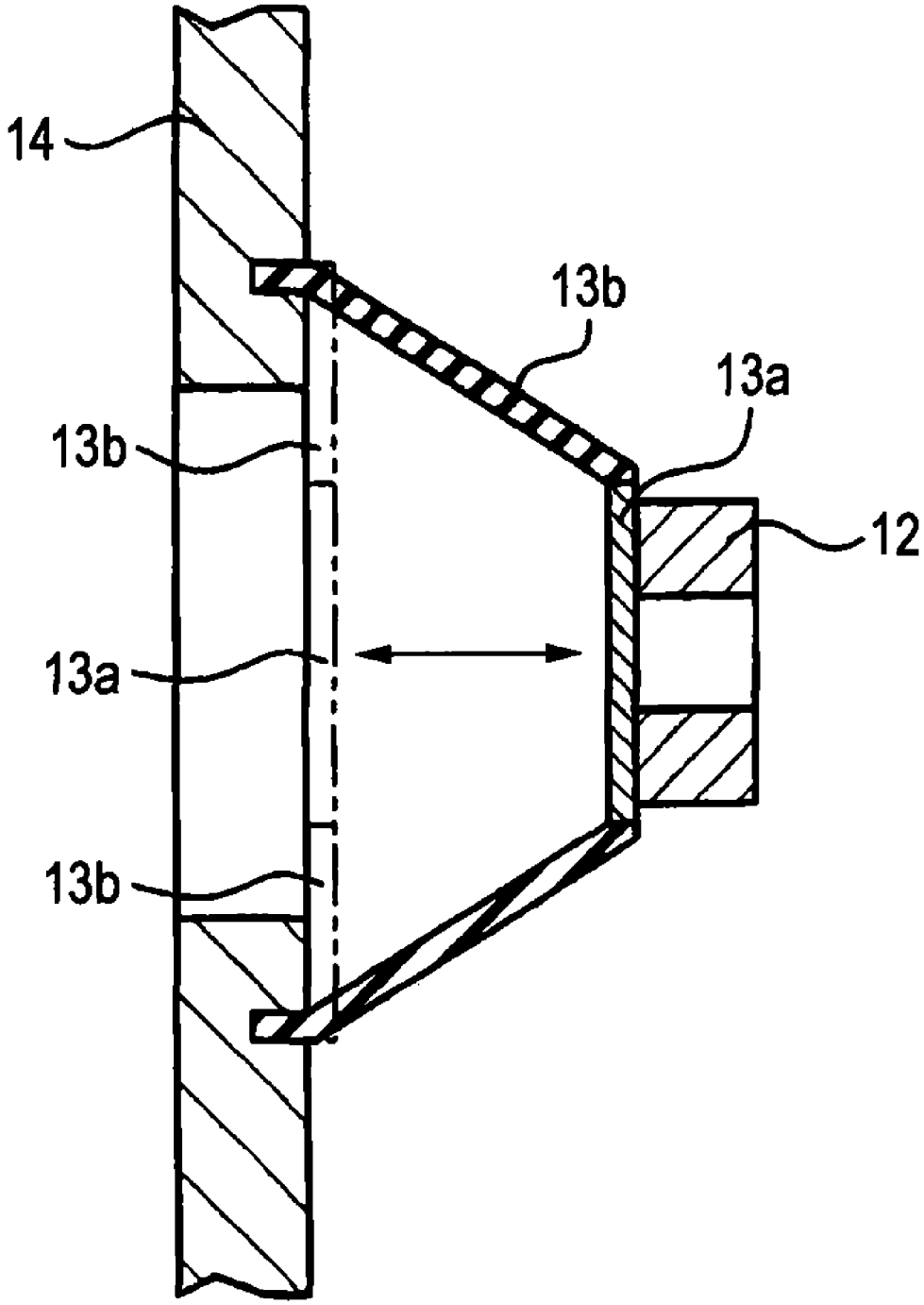
FIG. 5 is an explanatory view showing a structure of a musical instrument playing actuator according to a variation 2.

As the diaphragm member 13, like the projection member 12, either the material except the elastic material may be employed or the composite materials may be employed. In this case, unlike the projection member 12, the diaphragm member 13 must be constructed such that it can be moved toward the elastic diaphragm 11 side. For this reason, a part of the diaphragm member 13 must be formed flexibly. For example, as shown in FIG. 5, a contact portion 13*a* of the diaphragm member 13, which corresponds to the portion and its neighborhood contacting the projection member 12, may be formed of a metal, and an expansion portion 13*b* corresponding to the remaining portion may be formed of the elastic material. Here, in FIG. 5, a state where the diaphragm member 13 is not pushed in is indicated with a chain double-dashed line and a state where the diaphragm member 13 is pushed in and contacts the projection member 12 is indicated with a solid line. Also, the expansion portion 13*b* may be formed of not the elastic material but an extendible bellow structure. In this case, the expansion portion 13*b* is expanded by the pressing member 16, and then the expansion portion 13*b* is contracted when the contact portion 13*a* is pushed back by a tension of the elastic diaphragm 11 via the projection member 12.

Figure 6A:
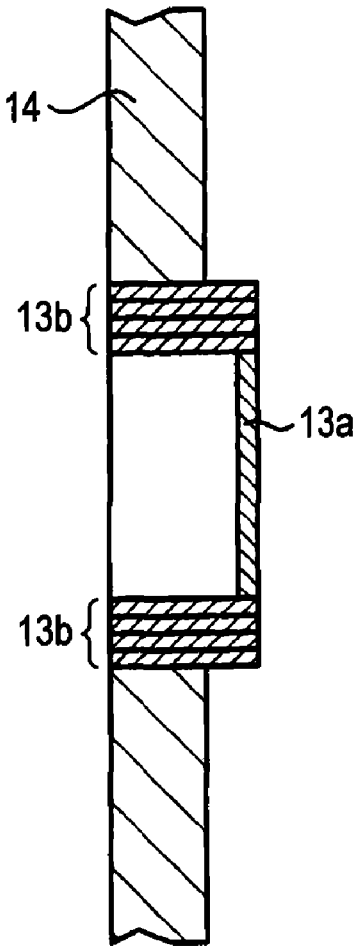
FIG. 6 an explanatory view showing the structure of the musical instrument playing actuator according to the variation 2.
Figure 6B:
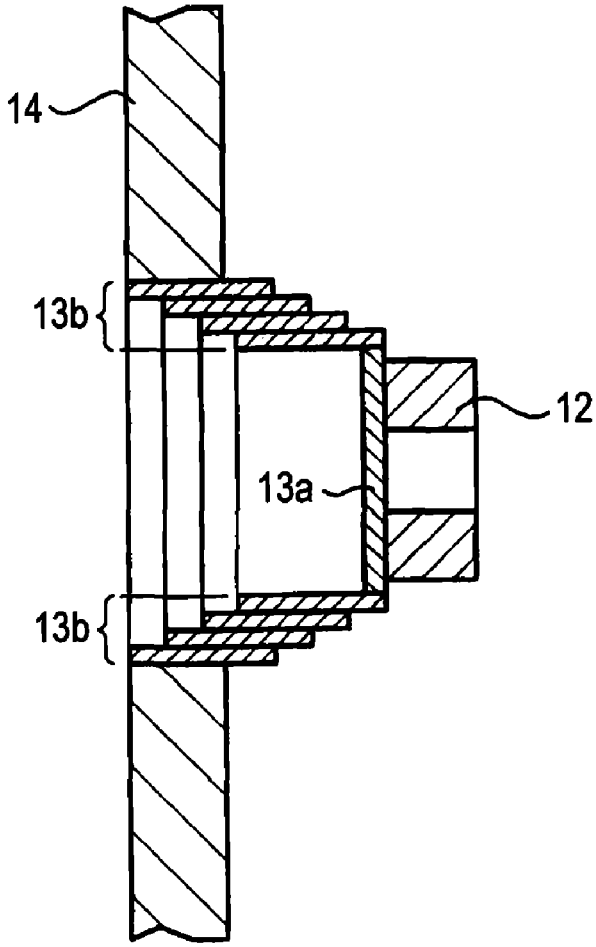

Also, as shown in FIG. 6, the expansion portion 13*b* of the diaphragm member 13 may be constructed by a plurality of cylindrical members having a different diameter respectively, and an extendible structure may be accomplished by sliding these members. Here, FIG. 6A shows a state where the diaphragm member 13 is not pushed in, and FIG. 6B shows a state where the diaphragm member 13 is pushed in and contacts the projection member 12. In this case, the expansion portion 13*b* is also expanded by the pressing member 16, and then the expansion portion 13*b* is also contracted when the contact portion 13*a* is pushed back by a tension of the elastic diaphragm 11 via the projection member 12. Here, when an expansion controlling section as a mechanism for expanding automatically the expansion portion 13*b* may be provided and the player may control an amount of expansion by controlling the expansion controlling section by an operating the operating section, the pressing member 16 may be omitted. Also, the player may control the pitch to be produced by operating the operating section. In this way, various structures of the diaphragm member 13 may be obtained without a film of the elastic material. Although the air inlet 14*a* is provided to the wall structure body 14 in the embodiment, the air inlet 14*a* may be provided to the expansion portion 13*b*.

<Variation 3>

Figure 7:
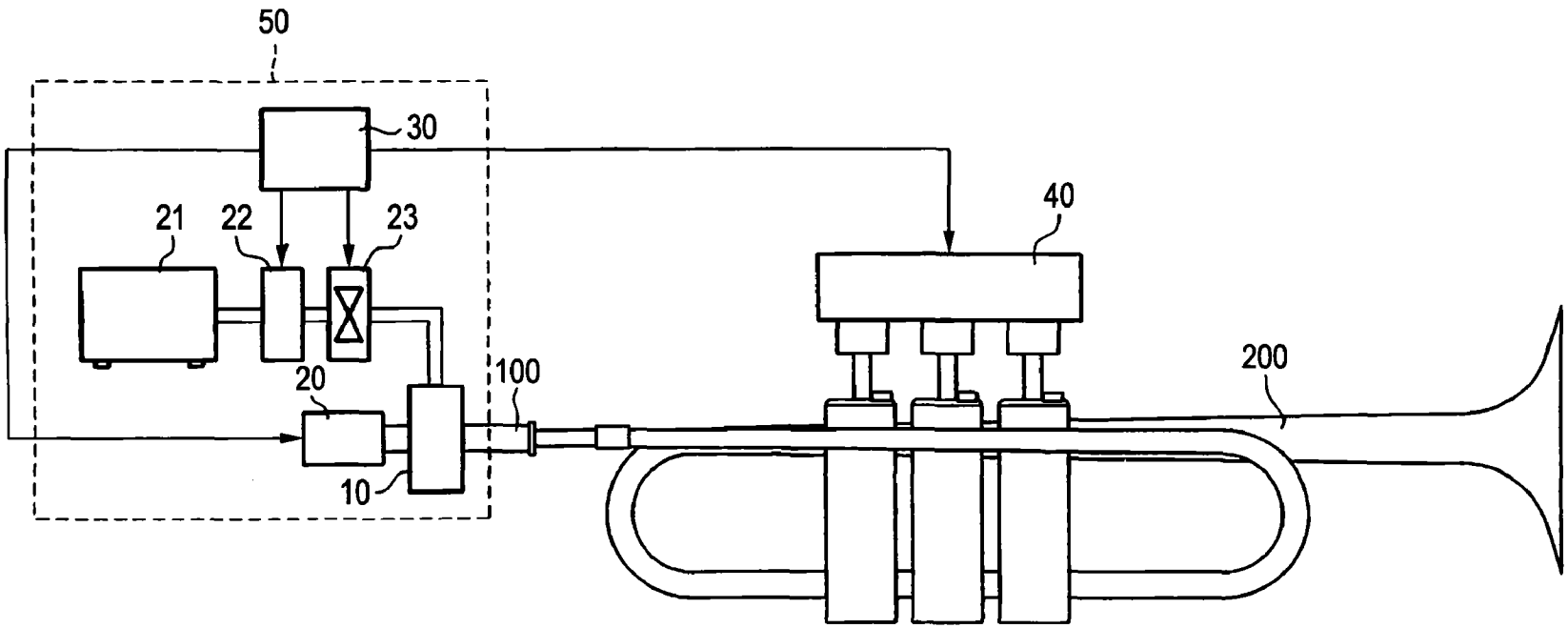
FIG. 7 is an explanatory view showing a configuration of an automatic playing apparatus according to a variation 3.

An automatic playing apparatus for playing automatically the brass instrument can be constructed by using the musical instrument playing actuator 10 in the embodiment. Next, a configuration of the automatic playing apparatus will be explained with reference to FIG. 7 hereunder, An actuator straight-moving unit 20 has a function of pushing in the pressing member 16 of the musical instrument playing actuator 10 shown in FIG. 4B at a pressure that is decided based on a pressure control signal being output from a control portion 30. An air compressor 21 generates a compressed air and accumulates an air at a predetermined pressure or more in a built-in tank. A flow rate of the compressed air discharged from the air compressor 21 is controlled by a solenoid valve 22 and a regulator 23, and this compressed air is supplied to the enclosed space 15 via the air inlet 14*a* of the musical instrument playing actuator 10. The solenoid valve 22 has a function of feeding the compressed air discharged from the air compressor 21 to the regulator 23 and shutting off the compressed air, based on an ON/OFF control signal being output from the control portion 30. The regulator 23 controls a flow rate of the compressed air based on a flow rate control signal being output from the control portion 30, and feeds the compressed air to the musical instrument playing actuator 10. A piston straight-moving unit 40 has a function of controlling vertical positions of respective pistons of a trumpet 200, based on a piston control signal being output from the control portion 30.

The control portion 30 acquires musical sound data in the MIDI (Musical Instrument Digital Interface) format indicating sound producing/silencing timings, the pitch, the sound volume, etc., and generates the ON/OFF control signal, the flow rate control signal, the pressure control signal, the piston control signal, etc. The ON/OFF control signal is generated for respective sounds that the musical sound data indicate such that the solenoid valve 22 supplies the compressed air to the regulator 23 during a period from a timing at which the sound is to be produced to a timing at which the sound is to be silenced (referred to as an "ON period" hereinafter. Periods except this period means OFF periods). The flow rate control signal is generated for respective sounds that the musical sound data indicate in such a way that a flow rate that the regulator 23 controls is increased as the sound volume is increased. The pressure control signal and the piston control signal are generated based on the pitch of each sound that the musical sound data indicate. Here, the control portion 30 stores a table in which data indicating the pressure (corresponding to the so-called "embouchure") and data indicating the operated piston (corresponding to the so-called "piston fingering") are correlated with the pitch, identifies the pressure corresponding the pitch that the musical sound data indicate and the operated piston based on this table, generates the pressure control signal based on the identified pressure, and generates the piston control signal based on the identified operated piston.

With such configuration, the automatic playing apparatus can play automatically the trumpet 200 based on the musical sound data that the control portion 30 acquires. Here, the player can practice the piston fingering by moving the piston not to use the piston straight-moving unit 40. Also, the automatic playing apparatus can be applied to another brass instrument such as a trombone, or the like instead of the trumpet 200. In this case, the piston straight-moving unit 40 may be modified to meet the moving portions of the brass instrument and also the table stored in the control portion 30 may be modified. For example, in the case of the musical instrument such as the trombone whose moving portion is the slide type, a straight-moving unit that can slide the slide tube of the trombone may be employed instead of the piston straight-moving unit 40. Then, the table that the control portion 30 stores may correlate the data indicating an amount of slide with the pitch instead of the data indicating the operated piston. When doing this, the automatic playing apparatus that can deal with various brass instruments can be accomplished.

<Variation 4>

Figure 8:
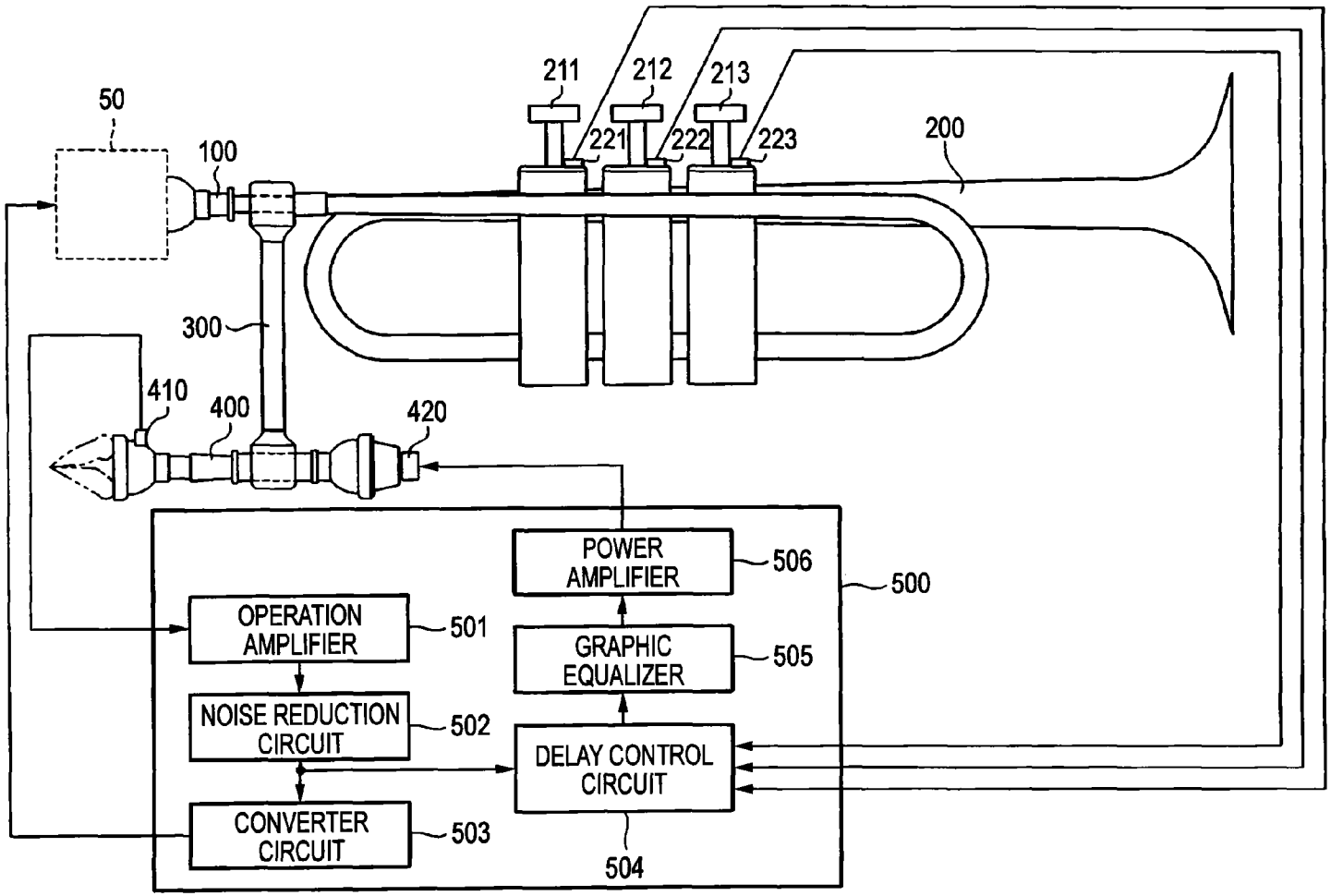
FIG. 8 is an explanatory view showing a configuration of a playing assisting system according to a variation 4.

A playing assisting system having a function of assisting the player's play of the brass instrument can be constructed by using the musical instrument playing actuator 10 in the embodiment. A configuration of the playing assisting system will be explained with reference to FIG. 8 hereunder.

The playing assisting system has an automatic playing unit 50. This automatic playing unit 50 is a part of the automatic playing apparatus according to variation 3, and has a function of the portion indicated with a broken line in FIG. 7. Also, in the playing assisting system, a player mouthpiece 400 is fitted to the mouthpiece 100 via a fitting member 300. The player plays the musical instrument by putting the player's lips to the player mouthpiece 400 provided separately from the mouthpiece 100 fitted to the actual trumpet 200 and blowing a breath into the player mouthpiece 400.

A sensor 410, a back pressure actuator 420, and an exhausting mechanism (not shown) are provided to the player mouthpiece 400. The sensor 410 is a sound sensing section for sensing a sound produced when the player blows a breath into the mouthpiece, and outputs a signal generated based on the sensed sound to an operation amplifier 501 described later. The exhausting mechanism is a mechanism for exhausting the brown-in breath of the player, so that a pressure in the player mouthpiece 400 is kept at a predetermined pressure or less.

The back pressure actuator 420 is an actuator that puts a back pressure on the player's lips. The "back pressure" means an influence (pressure action) upon an oscillating (sound producing) portion caused when the sound wave produced by the oscillating portion is reflected by the top end of the tube and is returned to the oscillating portion. When amplitude/phase of the returned sound wave synchronize with amplitude/phase of the sound wave from the oscillating portion, the vibration of the oscillating portion can be stabilized and amplified. In contrast, when both amplitudes/phases do not synchronize with each other, stability of the vibration of the oscillating portion is disturbed and the amplitude is suppressed. The back pressure actuator 420 has a speaker, and a diaphragm of the speaker is vibrated based on the signal output from a power amplifier 506, described later, to produce a back pressure on the blowing port of the player mouthpiece 400.

The signal output from the sensor 410 is output to the operation amplifier 501 of a signal processing portion 500. The operation amplifier 501 amplifies the signal output from the sensor 410. A noise reduction circuit 502 reduces a noise by deleting a signal whose signal level is less than a predetermined level from the signal output from the operation amplifier 501, and then outputs the resultant signal to a converter circuit 503 and a delay control circuit 504.

The converter circuit 503 senses the pitch and the sound volume of the sound indicated by the signal, based on the signal output from the noise reduction circuit 502. Also, the converter circuit 503 identifies a pause of the sound based on changes of the sensed pitch and the sensed sound volume. For example, when the pitch is changed to a predetermined level or more in a situation that a period in which the sound volume is below a predetermined level continued for a predetermined time or more, this change is identified as a pause of the sound. In this manner, the converter circuit 503 generates musical sound data based on sound producing/silencing timings of each sound and the pitch and the sound volume of each sound, which are decided every pause of the identified sound. At this time, the sound volume indicated by the musical sound data is set as a value that is larger than the sensed sound volume by a previously set level. Then, the converter circuit 503 outputs the generated musical sound data to the control portion 30 of the automatic playing unit 50. Hence, the automatic playing unit 50 causes the musical instrument playing actuator 10 to produce the sound in the way explained in the variation 3. At this time, the pitch indicated by the musical sound data that the control portion 30 of the automatic playing unit 50 acquired is converted into the data indicating the pressure, based on the table. As a result, even though the pitch of the sound produced by the player's blowing deviates slightly from the pitch to be produced essentially, such pitch is corrected and thus the musical instrument playing actuator 10 can produce the sound in right pitch.

Also, switches 221, 222, 223 are provided to a first piston valve 211, a second piston valve 212, and a third piston valve 213 of the trumpet 200 respectively. The switches 221, 222, 223 sense the player's operation applied to the first piston valve 211, the second piston valve 212, and the third piston valve 213 respectively, and output signals indicating the sensed results to the delay control circuit 504. The delay control circuit 504 delays the signals supplied from the noise reduction circuit 502 based on the signals fed from the switches 221, 222, 223, and outputs delayed signals to a graphic equalizer 505. Here, the delay control circuit 504 will be explained hereunder. In the delay control circuit 504, a delay time $\Delta t$ corresponding to the tube length of the trumpet 200 is set previously and also delay times $\Delta t1$, $\Delta t2$, $\Delta t3$ corresponding to the switches 221, 222, 223 are set previously respectively. Then, a delay time defined as an amount by which the delay control circuit 504 delays the signal supplied from the noise reduction circuit 502 is given as a time in which $\Delta t1$, $\Delta t2$, $\Delta t3$ are added selectively to $\Delta t$ in response to the signals supplied from respective switches. For example, a delay time is given as $\Delta t+\Delta t1$ when only the first piston valve 211 is pushed down by the player, and a delay time is given as $\Delta t+\Delta t2+\Delta t3$ when the second piston valve 212 and the third piston valve 213 are pushed down by the player.

The graphic equalizer 505 adjusts levels of particular frequency components of the signal supplied from the delay control circuit 504, and outputs the adjusted signal to the power amplifier 506. The power amplifier 506 amplifies the signal from the graphic equalizer 505, and supplies the amplified signal to the back pressure actuator 420.

An operation of the play assisting apparatus according the above configuration will be given as follows. First, when the player puts the lips to the player mouthpiece 400 and blows a breath into this mouthpiece, the produced sound is sensed by the sensor 410 fitted to the player mouthpiece 400. The operation amplifier 501 amplifies the signal output from the sensor 410, and outputs the amplified signal to the noise reduction circuit 502. The noise reduction circuit 502 reduces the noise by deleting the signal whose signal level is less than a predetermined level from the signal output from the operation amplifier 501, and then outputs the resultant signal to the converter circuit 503 and the delay control circuit 504. The converter circuit 503 produces the musical sound data by analyzing the signal output from the noise reduction circuit 502, and outputs the data to the control portion 30 of the automatic playing unit 50. The automatic playing unit 50 produces the sound by vibrating the elastic diaphragm 11 of the musical instrument playing actuator 10 based on the musical sound data.

Accordingly, the sound wave responding to the sound produced in the player mouthpiece 400 by the player's bowing is generated in the tube of the trumpet 200. The generated sound wave passes through the inside of the tube of the trumpet 200, and is discharged from the bell portion of the trumpet 200. Hence, the sound is discharged from the trumpet 200 in answer to the playing operation of the player. At this time, because the noise component is removed by the noise reduction circuit 502, the generated sound is increased by the automatic playing unit 50, and the pitch of the sound produced by the player is corrected and the corrected sound is emitted from the automatic playing unit 50, the good playing sound can be output even though the playing technique of the player is unskilled. Also, the pressure generated from the back pressure actuator 420 is generated in the tube of the player mouthpiece 400. As a result, the player can feel the back pressure at the lips as if he or she is playing the genuine trumpet.

In the present variation, the converter circuit 503 produces the musical sound data. In this case, the converter circuit 503 may not produce the musical sound data but output the data indicating the sound volume and the pitch sensed there to the control portion 30 of the automatic playing unit 50, and then the control portion 30 may generate the flow rate control signal based on the sound volume indicated by this data and generate the pressure control signal based on the pitch. Also, the ON/OFF control signal may be generated such that the ON period is produced only while the sound volume exceeds a predetermined value. Also, when the regulator 23 can control the flow rate up to a low flow rate, the solenoid valve 22 may be omitted. In this case, there is no need that the ON/OFF control signal should be generated.

<Variation 5>

In the automatic playing apparatus in the variation 3 and the play assisting apparatus in the variation 4, a feedback may be applied to the pressure control signal based on the sound produced in the musical instrument playing actuator 10. In this case, for example, a microphone for picking up the sound generated in the inside of the musical instrument playing actuator 10, e.g., the wall structure body 14 adjacent to the enclosed space 15 and the auxiliary space 19, or the like may be provided. Then, the control portion 30 identifies the pitch of the sound picked up by the microphone and feeds back the modified pressure control signal such that the identified pitch coincides with the pitch to be generated essentially. For example, when the identified pitch is lower than the pitch to be generated essentially, the pressure control signal is changed to increase the pressure. Here, the pitch to be generated essentially shows the pitch to be generated in the musical instrument playing actuator 10, and is correlated with the data indicating the pressure in the table stored in the control portion 30. In other words, the control portion 30 stores a table in which the data indicating the pitch to be generated in the musical instrument playing actuator 10, the data indicating the pressure, and the data indicating the piston to be operated are correlated with the pitch. Then, the control portion 30 generates the pressure control signal indicating the pressure decided by modifying the pressure that the table indicates, based on the pitch of the sound that microphone picked up and the pitch to be generated in the musical instrument playing actuator 10. With this arrangement, even when the relationship between the pushing stroke (pressure) of the pressing member 16 and the pitch of the sound produced by the vibration of the elastic diaphragm 11 is varied on account of a change in the playing environment, or the like, a deviation of the pitch caused due to the change can be corrected by applying the feedback.

<Variation 6>

In the embodiment, the through hole in the elastic diaphragm 11 is a circle, but the through hole is not always be shaped into a circle. In this case, any shape may be employed if the through hole is formed not to extend off the rim of the mouthpiece 100 when the elastic diaphragm 11 contacts the rim. Also, a natural oscillation frequency of the elastic diaphragm 11 and the projection member 12 is varied depending on the shape and the size of the through hole and the position on the elastic diaphragm 11. Therefore, the shape and the size of the through hole and the position on the elastic diaphragm 11 may be decided to get a desired natural oscillation frequency that fits the purpose of the playing.

<Variation 7>

In the embodiment, the musical instrument playing actuator 10 except the pressing member 16 has roughly a circular cylindrical shape. In this case, a quadrangular prism, a triangular prism, and other shapes may be employed. In this case, as the elastic diaphragm 11 and the diaphragm member 13, a quadrangular diaphragm, a triangular diaphragm, or the like may be employed instead of the circular diaphragm. When doing this, the similar advantages to those in the embodiment can be achieved.

What is claimed is:

1. A musical instrument playing actuator, comprising:

an elastic diaphragm having a through hole, and an annular projection portion;

a diaphragm member arranged opposing the elastic diaphragm and movable toward the elastic diaphragm, wherein the annular projection portion project toward the diaphragm member;

a wall structure body forming an enclosed space together with the elastic diaphragm, the diaphragm member, and the projection portion when the diaphragm member is moved toward the elastic diaphragm to contact the projection portion; and an air inlet communicating the enclosed space with outside.

2. The musical instrument playing actuator according to claim 1, wherein the projection portion is configured to surround a periphery of the through hole.

3. The musical instrument playing actuator according to claim 1, wherein the air inlet is provided on the wall structure body.

4. The musical instrument playing actuator according to claim 1, further comprising a pressing member that moves the diaphragm member toward the elastic diaphragm.

5. The musical instrument playing actuator according to claim 4, wherein the pressing member includes:

a blowing port for blowing an air into an internal space of the pressing member; and an air introducing path for connecting the internal space and the air inlet.

6. The musical instrument playing actuator according to claim 1, wherein at least a portion, which contacts the diaphragm member, of the projection portion is formed of an elastic material.

7. The musical instrument playing actuator according to claim 1, wherein at least a portion, which contacts the projection portion, of the diaphragm member is formed of an elastic material.

8. A play assisting mouthpiece, comprising:

the musical instrument playing actuator set forth in claim 1; and a mouthpiece for a brass instrument which includes a rim having an inner diameter, wherein a diameter of the through hole in the elastic diaphragm is smaller than the inner diameter of the rim, and wherein the musical instrument playing actuator is provided so that the rim comes into contact with the elastic diaphragm and surround the through hole in the elastic diaphragm.

9. A brass instrument to which the play assisting mouthpiece set forth in claim 8 is fitted.

10. An automatic playing apparatus, comprising:

the brass instrument set forth in claim 9;

a controlling section that acquires musical sound data having information to specify a pitch and a sound volume, decides a pressure based on the pitch of the musical sound data, outputs a pressure control signal indicating the pressure, decides a flow rate based on the sound volume of the musical sound data, and outputs a flow rate control signal indicating the flow rate;

a moving section that moves the diaphragm member toward the elastic diaphragm at the pressure indicated by the pressure control signal; and an air sending section that sends an air into the enclosed space at the flow rate indicated by the flow rate control signal via the air inlet.

11. A play assisting apparatus, comprising:

the automatic playing apparatus set forth in claim 10;

a sound sensing section configured to be provided to a player mouthpiece, for sensing the sound that is produced when a player's breath is blown into the blowing port of the player mouthpiece; and a musical sound data generating section that generates musical sound data based on the sound sensed by the sound sensing section, wherein the controlling section of the automatic playing apparatus acquires the musical sound data generated by the musical sound data generating section.

* * * * *